US007714280B2

(12) United States Patent
Komatsu et al.

(10) Patent No.: US 7,714,280 B2
(45) Date of Patent: May 11, 2010

(54) TIME-OF-FLIGHT SECONDARY ION MASS SPECTROMETER

(75) Inventors: Manabu Komatsu, Kawasaki (JP); Hiroyuki Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 12/117,527

(22) Filed: May 8, 2008

(65) Prior Publication Data

US 2008/0277576 A1 Nov. 13, 2008

(30) Foreign Application Priority Data

May 11, 2007 (JP) ..... 2007-126895

(51) Int. Cl.
*H01J 49/44* (2006.01)

(52) U.S. Cl. ..... 250/287

(58) Field of Classification Search ..... 250/287, 250/309, 423 R

See application file for complete search history.

(56) References Cited

U.S. PATENT DOCUMENTS

| | | | | |
|---|---|---|---|---|
| 7,629,576 | B2 * | 12/2009 | Schultz et al. | 250/287 |
| 2004/0132080 | A1 | 7/2004 | Kawaguchi et al. | |
| 2006/0183235 | A1 | 8/2006 | Hashimoto et al. | |
| 2007/0105087 | A1 | 5/2007 | Ban et al. | |
| 2008/0090267 | A1 | 4/2008 | Komatsu et al. | |

FOREIGN PATENT DOCUMENTS

| | | | |
|---|---|---|---|
| JP | 7-211282 | A | 8/1995 |
| JP | 2005-300480 | A | 10/2005 |
| JP | 2006-10658 | A | 1/2006 |

OTHER PUBLICATIONS

U.S. Appl. No. 12/120,512, filed May 14, 2008: Applicants: Manabu Komatsu, et al.

U.S. Appl. No. 12/098,822, filed Apr. 7, 2008; Applicants: Hiroyuki Hashimoto, et al.

U.S. Appl. No. 12/113,795, filed May 1, 2008; Applicants: Murayama Yohei, et al.

A. F. Maarten Altelaar, "Direct Molecular Imaging of *Lymnaea stagnalis* Nervous Tissue at Subcellular Spatial Resolution by Mass Spectrometry", Analytical Chemistry, vol. 77, No. 3, Feb. 1, 2005 pp. 735 to 741.

David G. Castner, "view from the edge" Nature Publishing Group. vol. 422, Mar. 13, 2003, pp. 129 and 130.

* cited by examiner

*Primary Examiner*—Kiet T Nguyen
(74) *Attorney, Agent, or Firm*—Fitzpatrick, Cella, Harper & Scinto

(57) ABSTRACT

A time-of-flight secondary ion mass spectrometer comprises an ion source which generates cluster ions each comprised of two or more atoms, a pulsing mechanism which pulses the cluster ions, a selecting mechanism which selects ions having a specific mass number from the pulsed cluster ions and passes the selected ions in an ON state of the selecting mechanism, and, passes the pulsed cluster ions without the selecting in an OFF state of the selecting mechanism, and a time-of-flight mass spectrometric unit which measures a mass spectrum of secondary ions generated from a sample using a difference in time of flight when the sample is irradiated with the ions passed through the selecting mechanism.

7 Claims, 3 Drawing Sheets

FIG. 4A
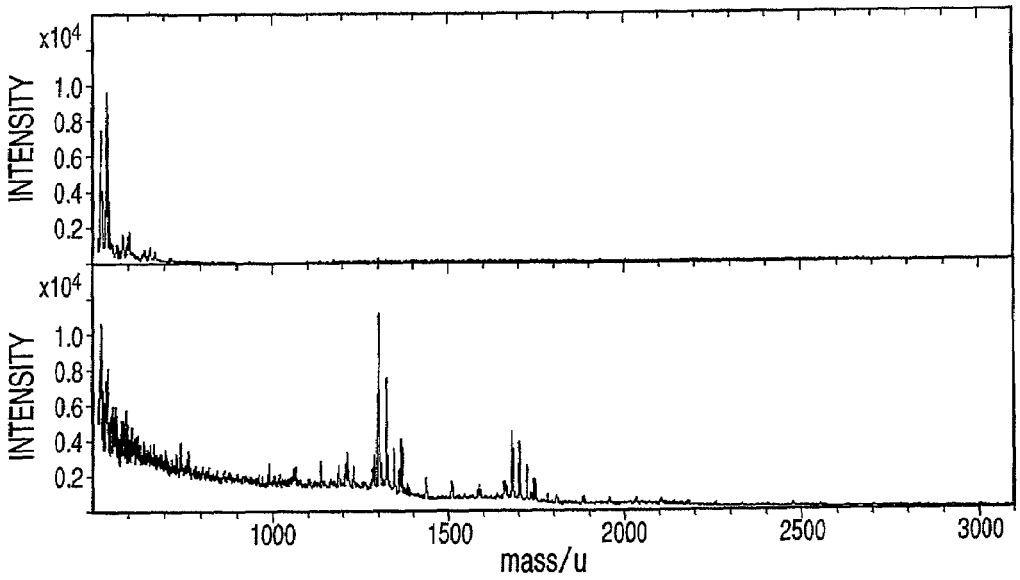
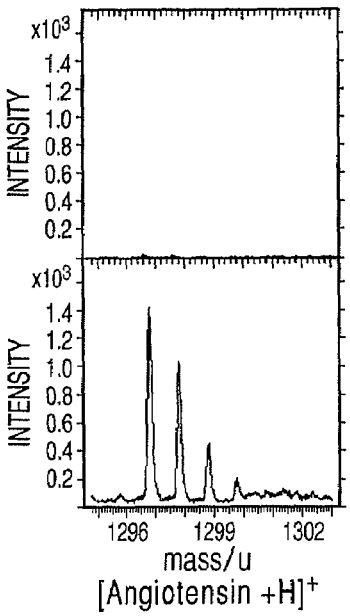
FIG. 4B
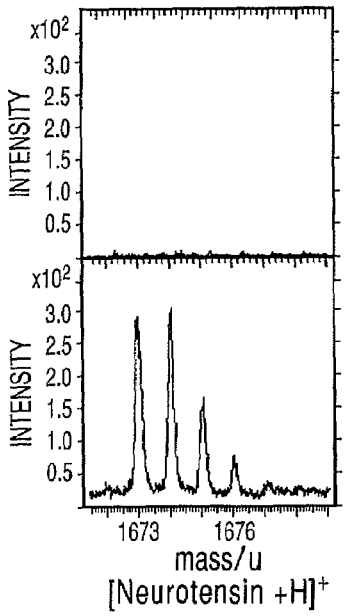
FIG. 4C
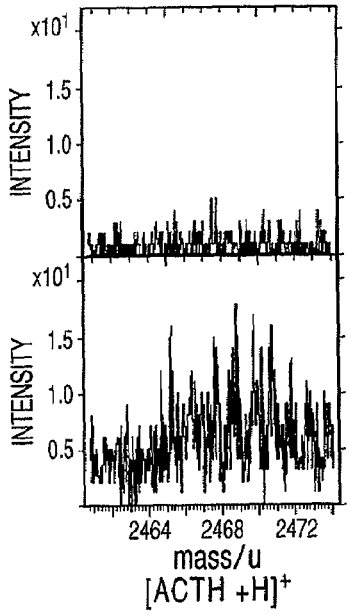
FIG. 4D

TIME-OF-FLIGHT SECONDARY ION MASS SPECTROMETER

BACKGROUND OF THE INVENTION

1. Field of the Invention

The present invention relates to a time-of-flight secondary ion mass spectrometer which can acquire information on a sample using a time-of-flight mass spectrometric unit. More specifically, the present invention relates to a time-of-flight secondary ion mass spectrometer which can perform imaging detection efficiently every kind of compositions which construct a sample, and in particular, organic substances such as protein and peptide (hereinafter, "polypeptide").

2. Description of the Related Art

A close-up of importance of analysis of protein which is a gene product which exists in a living body has been rapidly taken by development of genome (genome) analysis in recent years. In addition, up to now, importance of expression and performance analysis of protein has been pointed out, and development of their analytic methods has been advanced. These methods are based on combination of (1) separation refinement by two-dimensional electrophoresis or a High Performance Liquid Chromatograph (HPLC), and (2) a detection system such as radiometric analysis, optical analysis or mass analysis.

A ground of this protein analysis technique is called proteome (proteome) analysis, and this analyzes protein which is made from a gene and is actually acting in a living body. Then, it aims at finally investigating functions of a cell, and a cause of a disease. The following methods can be cited as typical analytic methods of this proteome analysis.

(1) Extraction of protein from a living body tissue or a cell which is a target (2) Separation of protein by two-dimensional electrophoresis (3) Analysis of protein or its fragment by mass analysis such as a MALDI method (Matrix Support Laser Desorption-Time-Of-Flight Mass Spectrometry: MALDI-TOFMS)

(4) Proteinic identification using databases such as the Genome Project database On the other hand, the present inventor proposed an information acquisition method and apparatus, which use the TOF-SIMS method (time-of-flight secondary ion mass spectrometry) as a base, in Japanese Patent Application Laid-Open No. 2006-10658. These information acquisition method and apparatus aim at visualization of a two-dimensional distribution of polypeptide in a protein chip or a cut piece of a living body tissue. This method attaches an ionization promoting agent and a digestive enzyme to the above-mentioned protein chip and cut piece of a living body tissue using an ink jet method or the like. Then, this method visualizes information (including information on peptide which is limitedly decomposed with the digestive enzyme) regarding a kind of protein by the TOF-SIMS method with keeping positional information.

Furthermore, as an example of analyzing polypeptide by the TOF-SIMS method, a method of detecting a polypeptide parent molecule with a large molecular weight by performing the same pretreatment as the MALDI method, that is, mixing polypeptide with a matrix substance is disclosed in A. F. Maarten et al. Anal. Chem., vol. 77, 735 (2005).

In D. G. Castner, Nature 422, and 129 (2003), a method of promoting ionization of high polymers with suppressing fragmentation, and improving ion detection sensitivity as a result is disclosed.

In the document, as a method of analyzing polypeptide effectively, examples using carbon 60 Fullerene (C60) ions, trimer cluster ($Au_3$, $Bi_3$) ions of metallic elements such as gold and bismuth and the like as primary ions in the TOF-SIMS method are described. Thereby, energy multiple scattering in very shallow bounds of a sample surface arises by radiation of primary ions. Then, it is described that many polymers which exist near the surface where the primary ions collide can be emitted (sputtering) softly.

In both of documents of Japanese Patent Application Laid-Open No. H07-211282 and Japanese Patent Application Laid-Open No. 2005-300480, methods of promoting fragment ionization of high polymers by improvement of an ionization mechanism in an analytical instrument including a time-of-flight mass spectrometer other than the TOF-SIMS method to obtain information on molecular structure are disclosed. More specifically, the former radiates a collision gas between an ion source and a mass spectrometric unit, and the latter makes an infrared laser beam radiated between an ion source and a mass spectrometric unit.

By an information acquisition method described in the above-mentioned Japanese Patent Application Laid-Open No. 2006-10658, information (including information on peptide which is limitedly decomposed by a digestive enzyme) regarding protein of a diseased tissue and a normal tissue is acquirable. Nevertheless, depending on a kind and a measuring condition of a sample, there was a case where detection sensitivity was not sufficient.

On the other hand, the method of Maarten et al. is a method which can suppress decomposition by primary ion irradiation even if it is polypeptide with a large molecular weight, and can detect a parent molecule with keeping original mass. Nevertheless, since this method made a test sample what polypeptide and a matrix substance are mixed, when a sample such as a protein chip is analyzed, it is not able to acquire original two-dimensional distribution information.

As improvement methods of apparatuses which use the TOF-SIMS method and solve the above issues, it is conceivable to apply methods, such as a MALDI method and an LC-TOFMS (Liquid Chromatograph Time-Of-Flight Mass Spectrometer) method. What is conceivable as its typical example is a method which is described in Japanese Patent Application Laid-Open No. H07-211282 and Japanese Patent Application Laid-Open No. 2005-300480 which are cited previously, and radiates a collision gas or an infrared laser beam between an ion source and a mass spectrometric unit to perform fragment ionization of and to detect polypeptide high polymers. Nevertheless, since a sample used as a measuring object was limited in these methods, and there were also few secondary ion amounts of emergence from a sample since the collision gas or infrared laser beam had comparatively low energy, measurement accuracy was limited.

Recently, an improved method widely used as a realistic method is the previously cited Castner's method of using metallic cluster ions such as C60, $Au_3$, and $Bi_3$ for primary ions. This method induces multiple scattering in a very shallow region of a sample surface by radiating metallic cluster ions as primary ions on a sample, and can emit polymer ions (including neutral ions) favorably with suppressing fragmentation. This method has an advantage of being possible not only to increase detection sensitivity of a polymer ion, but also to detect position distribution information in submicron order which is a characteristic of a metal ion beam. That is, this method has an advantage of improving the detection sensitivity of a polypeptide ion with a mass number of 200 to 1000 up to tens of times to hundreds of times in comparison with a case of gallium or argon which was conventionally used as a primary ion source.

Nevertheless, the Castner's method performs measurement and reforming of a sample surface by primary ion irradiation simultaneously. For this reason, an emission efficiency of the polymer ions from a sample was poor. In addition, since this method emitted polymer ions with inducing multiple scattering broadly, regions where these primary metallic cluster ions were radiated on a sample surface were extremely little to the extent of one atom per 100 atoms. For this reason, there was a problem that many portions of the sample surface were consumed vainly without providing an analysis.

As described above, it was hard in the analysis method using a conventional TOF-SIMS method to detect parent molecule ions of polypeptide with high sensitivity with maintaining positional information to a sample such as a protein chip or an organism specimen.

SUMMARY OF THE INVENTION

The present invention is made in view of the above-mentioned issues, and aims at generating secondary ions from a sample efficiently to analyze the sample with high sensitivity.

The present invention is directed to a time-of-flight secondary ion mass spectrometer, comprising: an ion source which generates a cluster ion comprised of two or more atoms; a pulsing mechanism which pulses the cluster ions; a selecting mechanism which selects an ion having a specific mass number from the pulsed cluster ions and passes the selected ions in an ON state of the selecting mechanism, and, passes the pulsed cluster ions without the selecting in an OFF state of the selecting mechanism; and a time-of-flight mass spectrometric unit which measures a mass spectrum of secondary ions generated from a sample using a difference in time of flight when the sample is irradiated with the ions passed through the selecting mechanism.

The time-of-flight secondary ion mass spectrometer can include: irradiating a sample with the cluster ions passed through the selecting mechanism without the selecting in the OFF state to reform the surface of the sample; switching the state of the selecting mechanism to ON state, followed by irradiating the sample having the reformed surface with the ions selected by and passed through the selecting mechanism; and measuring by the time-of-flight mass spectrometric unit a mass spectrum of secondary ions generated from the sample.

The pulsing mechanism can be a first chopping mechanism which passes ions from an opening to rotate. The selecting mechanism can be a second chopping mechanism which is apart by a constant distance from the first chopping mechanism and passes ions from the opening to rotate in an ON state, behind the passing of the first chopping mechanism.

The cluster ion generated by the ion source can include at least one kind of element selected from the group consisting of gold, silver, copper, platinum, palladium, rhodium, osmium, ruthenium, iridium, iron, tin, zinc, cobalt, nickel, chromium, titanium, tantalum, tungsten, indium, silicon, bismuth, carbon, lithium, potassium, sodium and gallium, and the cluster ion includes 2 to 100 atoms inclusive.

The time-of-flight secondary ion mass spectrometer can further comprise a unit of controlling an irradiation direction and speed of the cluster ions so that reforming of the surface of the sample occurs.

The time-of-flight secondary ion mass spectrometer can be an analysis apparatus of at least one kind of sample selected from the group consisting of protein, peptide, sugar chain, polynucleotide and oligonucleotide.

The time-of-flight secondary ion mass spectrometer of the present invention can generate secondary ions efficiently from a sample such as an organism specimen including a cell or a tissue. In consequence, it may be possible to analyze the sample with high sensitivity.

Further features of the present invention will become apparent from the following description of exemplary embodiments with reference to the attached drawings.

BRIEF DESCRIPTION OF THE DRAWINGS

FIG. 4A shows measurement results of secondary ion mass spectra in an Example (below) and a Comparative example (above) of the present invention, and FIGS. 4B, 4C, and 4D are diagrams illustrating a portion of FIG. 4A enlargingly.

DESCRIPTION OF THE EMBODIMENTS

Figure 1A:
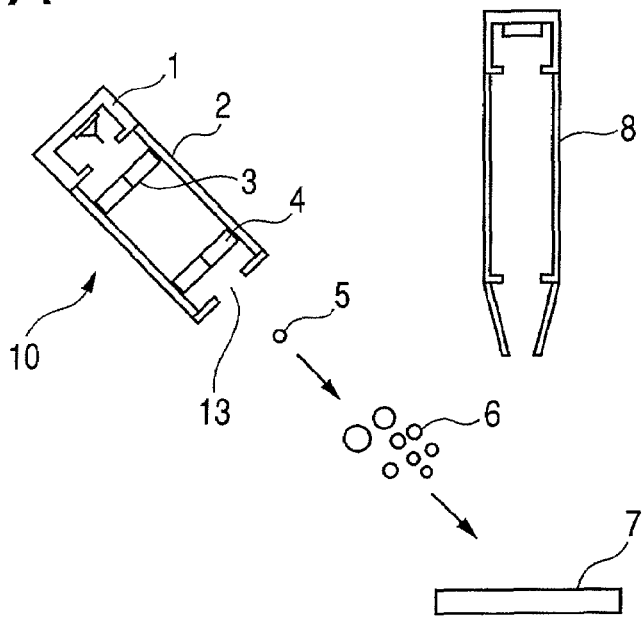
FIGS. 1A, 1B, 1C and 1D include diagrams illustrating an example of an ion irradiation unit of the present invention.

An apparatus of the present invention includes (1) ion irradiation unit, (2) sample stage, and (3) time-of-flight mass spectrometric unit. This apparatus is a time-of-flight secondary ion mass spectroscopy apparatus (Time of Flight Secondary Ion Mass Spectrometry: TOF-SIMS).

This (1) ion irradiation unit has the following units.

Ion source: To generate cluster ions which each are constructed of two or more atoms Pulsing mechanism: To pulse cluster ions Selecting mechanism: To select primary ions for measurement which each are constructed of ions with a specific mass number from cluster ions in an ON state, and to pass cluster ions in an OFF state. In addition, it is possible to switch the ON state and OFF state.

Then, the ion irradiation unit radiates cluster ions on a sample when the selecting mechanism is in an OFF state, and can reform a surface state of the sample. In addition, when the selecting mechanism is an ON state, the ion irradiation unit radiates primary ions for measurement to generate secondary ions from the sample, and the time-of-flight mass spectrometric unit can measure secondary ions.

Then, by a switching unit switching the ON state and OFF state, the ion irradiation unit can radiate primary ions for measurement on the sample with keeping cluster ions on the sample surface. In consequence, since a secondary ion amount of emergence from a sample is increased, it is possible to measure the sample with high precision and high sensitivity.

Hereinafter, each unit of the apparatus of the present invention will be described in detail.

(Ion Irradiation Unit)

An ion irradiation unit of the present invention has an ion source, a pulsing mechanism, and a selecting mechanism. FIGS. 1A to 1D includes diagrams illustrating an example of an ion irradiation unit 10 of the present invention. In the ion irradiation unit 10 in FIG. 1A, as an ion source 1, a liquid metal ion source system using a local high voltage application ionizing method by heating of a short needle type filament is used when using metal. In addition, when using a sublimable material as the ion source 1, a gasification electron impact mass spectrometry by an electron beam irradiation ionizing method to an evaporation gas by heating is used.

This ion source 1 can generate cluster ions which each are constructed of two or more atoms by performing acceleration with an extraction voltage, and can introduce the cluster ions into a mass selection tube 2. In addition, a system of the ion source 1 is not necessarily limited to these systems.

In addition, one cluster ion is constructed of two or more atoms, and a selecting mechanism can select primary ions for measurement which each are constructed of ions with a specific mass number m (mass)/z (charge). Furthermore, one cluster ion may be constructed of only one kind of elements, or may be constructed of plural kinds of elements.

For example, when a cluster ion is constructed of one kind of element A, this cluster ion is constructed of ions with different charges, or monomer or polymer ions. As such ions, $A^+$, $A^{2+}$, $A^-$, $A^{2-}$, $A_2^+$, $A_2^{2+}$, $A_2^-$, $A_2^{2-}$, $A_3^+$, $A_3^{2+}$, $A_3^-$, and $A_3^{2-}$ are cited. In addition, depending on the kind of element A, only a part of ions in these may exist, or ions other than these may exist. In addition, when a cluster ion is constructed of two or more kinds of elements, this cluster ion is constructed of ions with different charges, or monomer or polymer ions, every element.

Typically, although cluster ions are comparatively small one whose atomic numbers are two to five inclusive, some among them may become ones whose atomic numbers are 60 or more, and which have stable structure like carbon Fullerene. In addition, although ones with a bivalent or more charge are also included in cluster ions, almost all cluster ions become monovalent charges. In addition, the number of cluster ions included in one pulse is measurable with an ammeter using a Faraday cup function.

In the apparatus of the present invention, it is preferable to adjust an amount (current value) of cluster ions which are radiated on a surface 14 of a sample 7 at a moderate value by adjusting an extraction voltage of the ion source 1 or the like. For example, an amount (current value) of cluster ions suitable for, reforming and measuring an organic substance sample surface changes with a kind of a cluster ion source, an extraction voltage of ions or the like. However, in a normal sample, the amount that an exposure dose of cluster ions becomes $10^{14}$ pieces/cm$^2$ to $10^{15}$ pieces/cm$^2$ inclusive in an extraction voltage of 10 kV is preferable.

In addition, it is preferable that a cluster ion has the following construction of (A) and (B).

(A) The cluster ion includes at least one kind of element selected from the group consisting of gold, silver, copper, platinum, palladium, rhodium, osmium, ruthenium, iridium, iron, tin, zinc, cobalt, nickel, chromium, titanium, tantalum, tungsten, indium, silicon, bismuth, carbon, lithium, potassium, sodium, and gallium.

(B) One cluster ion includes 2 to 100 atoms inclusive.

It becomes easy to introduce a cluster ion into an interior of a sample surface by making the cluster ion into the above-mentioned construction of (A) and (B). In consequence, secondary ions can be more effectively generated from the sample surface 14.

In addition, it is preferable that an ion irradiation unit 10 is controllable so that reforming of a surface state of a sample and generation of secondary ions may occur in the same region of the sample 7 by adjusting irradiation directions and speeds of cluster ions and primary ions 5 for measurement.

For the purpose, for example, a polarization unit may be provided between the sample 7 and ion irradiation unit 10. Specifically, an application of an electromagnetic lens is desirable. This polarization unit can perform orientation so that the cluster ions 6 and primary ions 5 for measurement, which are radiated from the ion irradiation unit, may be corrected for deviation of fine irradiation positions generated because of difference between respective mass numbers, and may be radiated on the same specific surface position of the sample 7.

(Pulsing Mechanism)

Figure 1B:
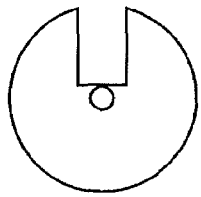

The cluster ions derived into the mass selection tube 2 in this way is guided to a first chopping mechanism 3 as shown in FIG. 1A. Here, an opening is provided in a part of a first chopping mechanism 3 (pulsing mechanism) as shown in FIG. 1B, and rotates at high speed. Hence, only when the opening of the first chopping mechanism 3 comes in the derivation direction from the ion source 1 by this rotation, cluster ions can pass the first chopping mechanism 3. In this way, the first chopping mechanism 3 can pulse the cluster ions derived from the ion source 1 as illustrated by an arrow 11 in FIGS. 1C and 1D.

In addition, it is possible to control a pulse width of the primary ions 5 for measurement and the cluster ions 6 by adjusting the rotation speed of this first chopping mechanism 3 (pulsing mechanism). As for the pulse width of the primary ions for measurement and cluster ions, it is preferable to be 0.01 ns to 10 ns inclusive, and it is more preferable to be 0.1 ns to 1 ns inclusive.

(Selecting Mechanism)

Figure 1C:
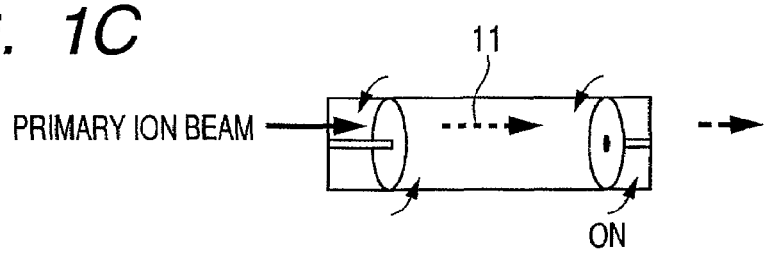

In addition, as shown in FIG. 1A, a second chopping mechanism 4 (selecting mechanism) which can select ions with a specific mass number from cluster ions is installed near an exit 13 of the mass selection tube 2. Then, as shown in FIGS. 1C and 1D, the second chopping mechanism 4 can be switched to an ON state or an OFF state typically in a cycle of 0.1 kHz to 10 kHz inclusive.

Figure 1D:
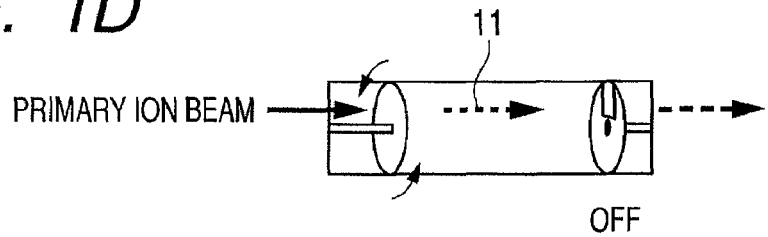

As illustrated in FIG. 1D, the apparatus of the present invention radiates cluster ions 6 on the sample 7 when the selecting mechanism 4 is in an OFF state, and can reform a surface state of the sample 7. In addition, as illustrated in FIG. 1C, when the selecting mechanism 4 is in an ON state, the apparatus radiates the primary ions 5 for measurement, which each are constructed of ions with a specific mass number, on the sample 7 by a distance between the first chopping mechanism 3 and second chopping mechanism 4, and deviation of rotating synchronization of respective chopping mechanisms. Then, secondary ions are generated from the surface 14 of the sample 7, and the secondary ions can be measured by a time-of-flight mass spectrometric unit 8.

Hereinafter, a state of a sample surface at the time when the selecting mechanism 4 of the present invention is in an ON state and an OFF state will be described in detail.

(a) When selecting mechanism 4 is in OFF state:

When the selecting mechanism 4 is made into an OFF state, the pulsed metal cluster ions 6 are directly radiated on the sample, and can reform the surface of the sample 7.

Figure 2:
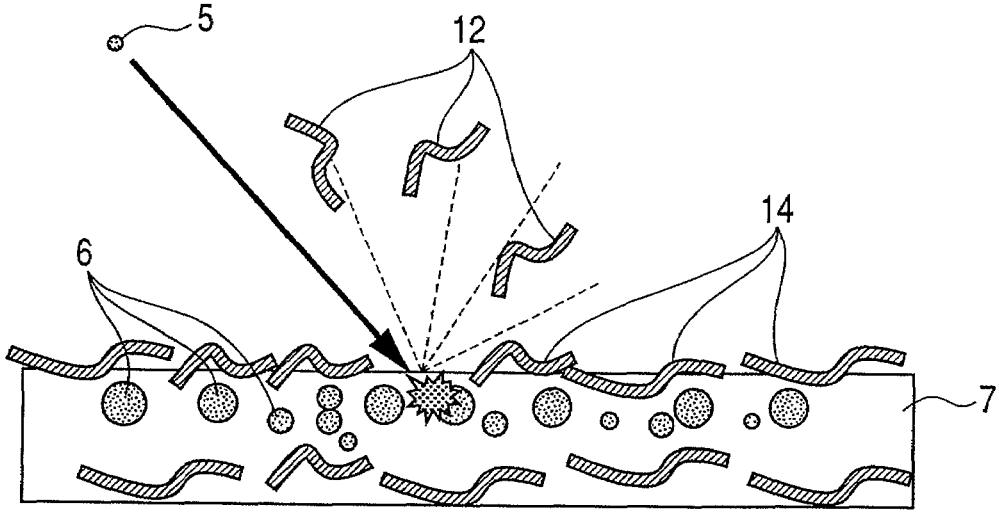
FIG. 2 is a diagram illustrating an analytical process of a sample by the time-of-flight secondary ion mass spectrometer of the present invention.

That is, as illustrated in FIG. 2, the following surface treatment effects can be obtained.

- A large number of cluster ions 6 and their component ions are arranged in the sample 7 by radiation of many cluster ions 6 on the surface of the sample 7. Thereby, since conductivity of the surface of the sample 7 is improved, it is possible to prevent the surface of the sample 7 from being charged by radiation of the primary ions 5 for measurement at the time of secondary ion detection (when a selecting mechanism is in an ON state).
- Enhancement in a rate of charge supply from the sample 7 can enhance an ionization rate of the secondary ions 12.
- Since the cluster ions 6 are introduced and arranged in a certain depth inside the surface of the sample 7, the primary ions 5 for measurement abut on surfaces of the cluster ions 6 through an organic layer. In consequence, since it may be possible to jump the secondary ions 12 upward from the surface of the sample 7 efficiently with recoil energy at this time, it is possible to enhance a production efficiency of the secondary ions 12.

(b) When selecting mechanism 4 is in ON state:

When the selecting mechanism 4 is made into the ON state, mass selection of the primary ions 5 for measurement which are constructed of ions with a specific mass number m (mass)/z (charge) from among cluster ions by the selecting mechanism 4 is performed. In addition, this mass selection by a selecting mechanism performs time-of-flight decomposition with the distance between two chopping mechanisms, and deviation of the rotating synchronization. Thereby, only ions with a specific mass number can be pulled out from the second chopping mechanism 4. At this time, as the primary ions 5 for measurement, it is sufficient to be only one kind of ions, or to be plural kinds of ions. In addition, the primary ions 5 for measurement may be constructed of only one kind of elements, or may be constructed of plural kinds of elements.

As a specific example, when using 25-kV bismuth cluster ions, a distance between both these chopping mechanisms 3 and 4 is set at 10 cm, and a rotational cycle is set at 10 kHz. At this time, deviation (delay) of rotating synchronization of the first chopping mechanism 3 to the second chopping mechanism 4 is set at about 40 to 60 ns. Then, it is adapted to perform selective extraction of only the cluster ions ($Bi_3^+$) in a bismuth trimer from among the cluster ions.

What is preferable as an ion which constructs this primary ion for measurement is a gallium ion, a cesium ion, a golden (Au) ion or the like. Ionization efficiency and mass resolution can be enhanced by using these ions. When an Au ion is used from among these ions, it is more preferable in view of an analysis with extremely high sensitivity can be performed. Since an $Au_2$ ion and an $Au_3$ ion can be used instead of an Au ion or with an Au ion and an increase of sensitivity is aimed at in this order at this time in many cases, utilization of golden polyatomic ions becomes a more preferable form. In addition, bismuth ions, C60 ions and the like can be also used as polyatomic ions other than gold.

By turning on this selecting mechanism, it is adapted to radiate primary ions 5 with a specific element and mass as primary ions for measurement in a pulsed state (an arrow 11 in FIG. 1C) on a region of the sample 7 which was reformed previously. In this way, since the primary ions 5 for measurement are radiated on the surface of the sample 15 in the reformed state when the selecting mechanism is in an ON state, it is possible to generate the secondary ions 12 from the sample surface 14 efficiently. In consequence, it may be possible to perform an analysis with high sensitivity with keeping a distribution state of a subject in the sample.

Then, in the present invention, it is preferable that the above-mentioned ON state and OFF state of a selecting mechanism are changed in a cycle of 0.1 kHz to 10 kHz inclusive. Thereby, it is possible to radiate the primary ions for measurement on the sample to generate the secondary ions efficiently in a short time when cluster ions can stay on the sample surface.

In addition, in the apparatus of the present invention, a pulse width of the primary ions for measurement and the cluster ions is shorter than the time when the selecting mechanism is in an ON state or an OFF state (usually the hundreds ps to thousands ps). For this reason, the primary ions for measurement and the cluster ions which are radiated when the selecting mechanism becomes in one set of an ON state and an OFF state respectively become hundreds to tens of thousands of pulses.

Furthermore, it is not necessary to change an irradiation energy value, a pulse period and the like of the primary ions for measurement and the cluster ions at the time of making the selecting mechanism into an ON state and an OFF state. In addition, it is also good to perform a pulse convergence (bunching) mode which has an effect of enhancing a functional mass resolution, condensing by an electromagnetic lens, and scanning of a beam at the time of turning the selecting mechanism on similarly to a primary ion gun of a normal TOF-SIMS.

It is preferable to set a beam diameter of the primary ions for measurement in a range of 1 μm to 10 μm inclusive. In addition, it is preferable to set an irradiation angle of the cluster ions and primary ions for measurement on a sample surface at 45° to 60° from the normal direction of a sample stage. In addition, among from the angle within this range, it is preferable that the angle is an angle, at which both effects of sputtering on the sample surface and embedding of cluster ions are generated moderately.

(Sample Stage)

A sample stage of the apparatus of the present invention is provided in a vacuum chamber, and can hold a sample.

It is preferable that the sample stage is switchable so that a negative voltage may be applied to a sample when a selecting mechanism is in an OFF state and a positive voltage may be applied to the sample when the selecting mechanism is in an ON state.

Figure 3:
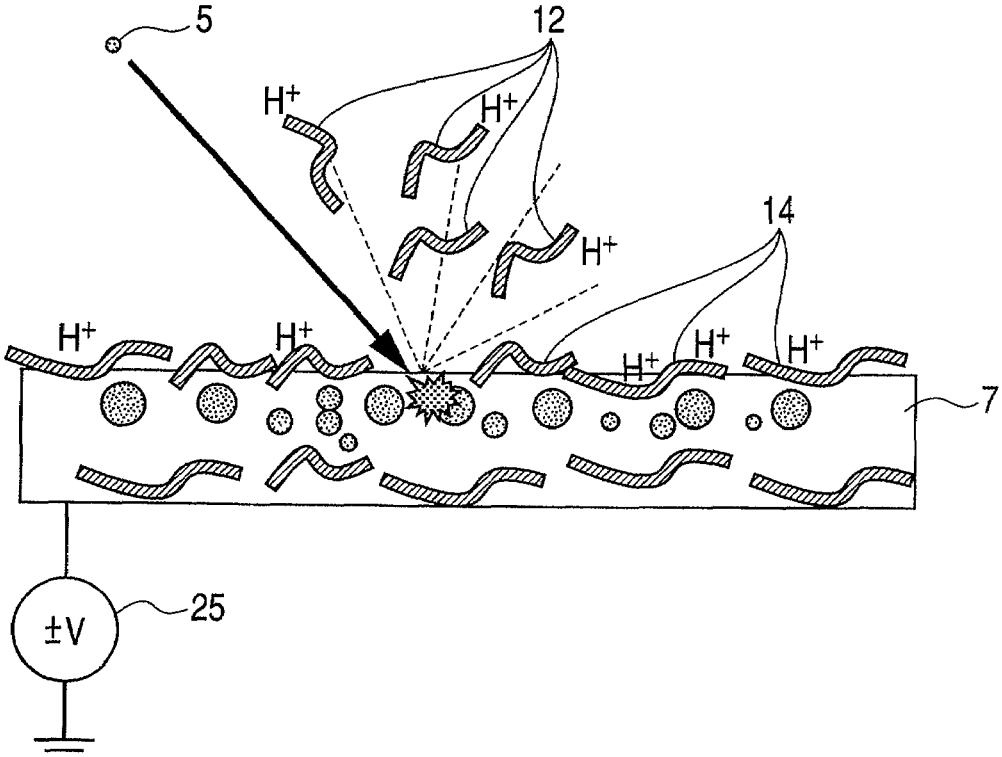
FIG. 3 is a diagram illustrating an analytical process of a sample by the time-of-flight secondary ion mass spectrometer of the present invention.

An example of an organic substance analysis at the time of applying a voltage to the above-mentioned sample stage will be described using FIG. 3. First, cluster ions are radiated by an ion irradiation unit for surface treatment of the sample (at this time, the selecting mechanism is in an OFF state). Thereby, many proton ions ($H^+$) are generated from hydrogen atoms included in organic molecules 14 of the sample surface. This $H^+$ is once emitted from the sample 7 together with other electrons or a neutral particle. However, by setting a polarity of a sample bias (a voltage 25 applied to the sample 7 by being applied to the sample stage) negative at this time, it is possible to pull $H^+$ with a positive charge back to the sample surface to make it stay stably for a short time inside the sample.

Next, before a charge of this $H^+$ disappears, the polarity of the sample bias is inverted to be positive, and simultaneously, the primary ions 5 for measurement are radiated on a reformed surface area (at this time, the selecting mechanism is in an ON state). Since the positive voltage applied to the sample stage and $H^+$ in the sample 7 become voltages with the same polarity at this time, it becomes easy for $H^+$ to separate from the sample 7 by a repulsive force. In consequence, $H^+$ ions adhere to neutral ions generated by a sputtering action for many $H^+$ adduct ions with a positive charge to be formed. Hence, an amount of the secondary ions 12 of the organic molecules 14 by radiating the primary ions 5 for measurement increases, and hence, it is possible to enhance measuring sensitivity.

In addition, in particular, since $H^+$ has very high adsorptivity with an organic molecule, an effect of this ion generation with $H^+$ attachment becomes remarkably high in an organic molecule analysis. That is, the apparatus of the present invention can be most suitably used for an analysis of a sample which is constructed of organic molecules such as a normal cell and a tissue. As these organic molecules, at least one kind of sample selected from a group consisting of protein, peptide, sugar chain, polynucleotide, and oligonucleotide can be analyzed.

(Time-of-flight Mass Spectrometric Unit)

Next, the secondary ions generated as described above converge in one direction using an electric field by a convergence unit, and are introduced into the time-of-flight mass spectrometric unit 8 apart by a constant distance from the sample stage.

The time-of-flight mass spectrometric unit 8 can perform a mass analysis by measuring time of flight of the secondary ions 12 generated from the sample surface. That is, when the primary ions 5 for measurement are radiated on the sample surface, the secondary ions 12 having various mass according to composition of the sample surface are generated. At this time, a lighter ion flies faster, and a heavier ion flies slower. For this reason, it may be possible to perform the mass analysis of the generated secondary ions by measuring time (time of flight) from the secondary ions being generated to being detected.

In addition, in the apparatus of the present invention, since the secondary ions 12 are generated only from the component 14 of an outermost part of the sample surface where the primary ions 5 for measurement were radiated, minute information of the outermost sample surface (a depth of several nanometers) can be obtained. In addition, since the apparatus of the present invention reforms the sample surface with the cluster ions 6, it is possible to perform an analysis with a very small exposure dose of primary ions 5 for measurement, and hence, there is no possibility of breaking or deteriorating chemical structure of the sample surface. For this reason, the apparatus of the present invention can be used as an analysis apparatus of at least a kind of sample, whose chemical structure deteriorates easily, selected from a group consisting of protein, peptide, sugar chain, polynucleotide, and oligonucleotide. Furthermore, the apparatus of the present invention can measures an ion image (mapping) of the sample surface by making a primary ion beam for measurement scan a sample surface. It is preferable that this time-of-flight mass spectrometric unit 8 is constructed so that continuous measurement of the time of flight of secondary ions can be performed.

In addition, a detecting unit, which measures the time of flight of the secondary ions 12, of the time-of-flight mass spectrometric unit 8 of the present invention has an ion-extraction electrode section. It is preferable that this time-of-flight mass spectrometric unit 8 is switchable so that a negative voltage may applied to the ion-extraction electrode section when a selecting mechanism is in an OFF state, and a positive voltage may be applied to the ion-extraction electrode section when the selecting mechanism is in an ON state. In the time-of-flight mass spectrometric unit 8 of the present invention, typically, a distance between the ion-extraction electrode section and the sample is extremely close, that is, about 1.5 mm. For this reason, there is the same effect as making a polarity of the sample bias of the above-described sample stage negative by applying a negative voltage to the ion-extraction electrode section in the OFF state. For this reason, it is possible to pull $H^+$ with a positive charge more efficiently back to the sample surface, to increase a secondary ion amount of organic molecules, and to enhance measuring sensitivity. In consequence, it is possible to analyze the secondary ions more efficiently.

EXAMPLES

An Example where an analysis was performed by using the TOF-SIMS apparatus of the present invention is illustrated below. As this TOF-SIMS apparatus, what an ion irradiation unit of a TOF-SIMS (trade name) spectrometer made by ION-TOF was improved was used. That is, an ion irradiation unit which uses a gun (ion source) which could generate Bi cluster ions which each were constructed of two or more Bi atoms as an ion source, and which includes a first chopping mechanism (pulsing mechanism) and a second chopping mechanism (selecting mechanism) was used. In addition, it is adapted to control rotational frequencies of the first and second chopping mechanisms. Furthermore, the second chopping mechanism (selecting mechanism) was made to have a cycle of 0.1 kHz to 10 kHz, and to be able to switch the ON state and OFF state described below.

OFF state: A sample surface treatment mode of transmitting Bi cluster ions and radiating the Bi cluster ions toward the sample from the ion irradiation unit.

ON state: A secondary ion measuring mode of selecting only $Bi_3^+$ as primary ion for measurement from Bi cluster ions, and radiating only the $Bi_3^+$ toward the sample from the ion irradiation unit.

In addition, the time-of-flight mass spectrometric unit was provided in this apparatus, and it was possible to perform mass analysis by measuring a time of flight of the secondary ions generated from the sample surface. Then, a polypeptide film sample was measured using the above-mentioned apparatus. An outline of a used sample and measuring conditions will be summarized below.

Preparation of Sample

First, a sample was produced as follows. A 1×1 $cm^2$ silicon substrate which did not include impurity was prepared, and this was cleaned in order of acetone and deionized water.

Next, the following three polypeptide aqueous solutions were prepared into 1 ng/μl using milQ water (ultrapure water system WR600G, made by Yamato Scientific Co., Ltd.) respectively. Then, a mixed solution into which respective 100 μl of three polypeptide aqueous solutions were mixed was adjusted (hereinafter, this mixed solution is described to be a "mixed polypeptide solution").

Angiotensin I (hereinafter, this is described as "Angiotensin") (SEQ ID NO:1, average molecular weight: 1295.51, made by NEB Inc.).

Neurotensin (SEQ ID NO:2, average molecular weight: 1672.96).

ACTH (18-39) (hereinafter, this is described as "ACTH") (adrenocorticotrophin SEQ ID NO:3, average molecular weight: 2465.72).

Next, by dropping 20 μl of this mixed polypeptide solution on the silicon substrate with a micro pipetter, and performing natural drying to form a film whose film thickness was about several μm at about 2 mm of diameter, a sample was formed. Then, this sample was installed on a sample stage of the above-mentioned apparatus.

Subsequently, in order to verify properly effects of the present invention, main measurement (Examples) and reference measurement (Comparative examples) were performed in almost neighboring positions on the same sample.

Below, analysis conditions in the main measurement are described.

Cluster ions: Bi cluster ion group, 15 kV 100 pA (pulse current value)

Primary ions for measurement: $Bi_3^+$, 15 kV 0.3 pA (pulse current value)

Scanning: sawtooth scanning mode, 300×300 $\mu m^2$

Pulse frequency of primary ions for measurement and cluster ions: 3.3 kHz

Pulse width of primary ions for measurement: About 0.8 ns

Beam diameter of primary ions for measurement: About 3 μm

Frequency of mode switching of ON state and OFF state: 0.1 kHz

Sample bias (applied voltage of sample stage): −30V (selection unit: OFF state), +30V (selection unit: ON state)

Applied voltage of detector of a time-of-flight mass spectrometric unit: +2 kV only in measurement Accumulated time: About 400 seconds.

In addition, in the reference measurement, irradiation of cluster ions was not performed on the analysis conditions in this above-mentioned main measurement, but only irradiation of primary ions for measurement by $Bi_3^+$ was performed. In addition, at this time, the sample bias (applied voltage of the sample stage) was always set at +30V.

FIGS. 4A to 4D illustrate results of having measured secondary ion mass spectra of the sample by the above-mentioned main measurement and reference measurement. In addition, FIG. 4A illustrates measurement results in a broader-based mass region of the main measurement and reference measurement. In addition, FIGS. 4B to 4D illustrate enlarged views of measurement results of $[Angiotensin+H]^+$, $[Neurotensin+H]^+$, and $[ACTH+H]^+$ respectively. From the results of FIGS. 4A to 4D, it is turned out that values of all the spectra become larger by using the apparatus of the present invention, secondary ions are detected efficiently, and measuring sensitivity is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-126895, filed May 11, 2007, which is hereby incorporated by reference herein in its entirety.

SEQUENCE LISTING

```
<160> NUMBER OF SEQ ID NOS: 3

<210> SEQ ID NO 1
<211> LENGTH: 10
<212> TYPE: PRT
<213> ORGANISM: Artificial
<220> FEATURE:
<223> OTHER INFORMATION: Angiotensin I

<400> SEQUENCE: 1

Asp Arg Val Tyr Ile His Pro Phe His Leu
1               5                   10


<210> SEQ ID NO 2
<211> LENGTH: 13
<212> TYPE: PRT
<213> ORGANISM: Artificial
<220> FEATURE:
<223> OTHER INFORMATION: Neurotensin

<400> SEQUENCE: 2

Glu Leu Tyr Glu Asn Lys Pro Arg Arg Pro Tyr Ile Leu
1               5                   10


<210> SEQ ID NO 3
<211> LENGTH: 22
<212> TYPE: PRT
<213> ORGANISM: Artificial
<220> FEATURE:
<223> OTHER INFORMATION: ACTH(18-39)

<400> SEQUENCE: 3

Arg Pro Val Lys Val Tyr Pro Asn Gly Ala Glu Asp Glu Ser Ala Glu
1               5                   10                  15

Ala Phe Pro Leu Glu Phe
            20
```

What is claimed is:

1. A time-of-flight secondary ion mass spectrometer, comprising:

an ion source which generates cluster ions each comprised of two or more atoms;

a pulsing mechanism which pulses the cluster ions;

a selecting mechanism which selects ions having a specific mass number from the pulsed cluster ions and passes the selected ions in an ON state of the selecting mechanism, and passes the pulsed cluster ions without the selecting in an OFF state of the selecting mechanism; and a time-of-flight mass spectrometric unit which measures a mass spectrum of secondary ions generated from a sample using a difference in time of flight when the sample is irradiated with the ions passed through the selecting mechanism.

2. The time-of-flight secondary ion mass spectrometer according to claim 1, including:

irradiating a sample with the cluster ions passed through the selecting mechanism without the selecting in the OFF state to reform the surface of the sample;

switching the state of the selecting mechanism to ON state, followed by irradiating the sample having the reformed surface with the ions selected by and passed through the selecting mechanism; and measuring by the time-of-flight mass spectrometric unit a mass spectrum of secondary ions generated from the sample.

3. The time-of-flight secondary ion mass spectrometer according to claim 1, wherein the pulsing mechanism is a first chopping mechanism which passes ions from an opening to rotate.

4. The time-of-flight secondary ion mass spectrometer according to claim 3, wherein the selecting mechanism is a second chopping mechanism which is apart by a constant distance from the first chopping mechanism and passes ions from the opening to rotate in an ON state, behind the passing of the first chopping mechanism.

5. The time-of-flight secondary ion mass spectrometer according to claim 1, wherein the cluster ion generated by the ion source include at least one kind of element selected from the group consisting of gold, silver, copper, platinum, palladium, rhodium, osmium, ruthenium, iridium, iron, tin, zinc, cobalt, nickel, chromium, titanium, tantalum, tungsten, indium, silicon, bismuth, carbon, lithium, potassium, sodium and gallium, and the cluster ion includes 2 to 100 atoms inclusive.

6. The time-of-flight secondary ion mass spectrometer according to claim 1, further comprising a unit of controlling an irradiation direction and speed of the cluster ions so that reforming of the surface of the sample occurs.

7. The time-of-flight secondary ion mass spectrometer according to claim 1, wherein the time-of-flight secondary ion mass spectrometer is an analysis apparatus of at least one kind of sample selected from the group consisting of protein, peptide, sugar chain, polynucleotide and oligonucleotide.

* * * * *